United States Patent [19]

Finley et al.

[11] 4,130,049

[45] Dec. 19, 1978

[54] VENT CONTROL FOR CYLINDER MOUNTED LOAD CHECK VALVES

[75] Inventors: Lloyd D. Finley, Lockport; Leroy F. Kusper, Braidwood, both of Ill.

[73] Assignee: Caterpillar Tractor Co., Peoria, Ill.

[21] Appl. No.: 785,628

[22] Filed: Apr. 7, 1977

[51] Int. Cl.[2] ..... F15B 11/08; F15B 13/042

[52] U.S. Cl. ..... 91/445; 91/447; 137/596.2

[58] Field of Search ..... 91/445, 447; 137/596.2

[56] References Cited

U.S. PATENT DOCUMENTS

| | | | |
|---|---|---|---|
| 1,420,256 | 6/1922 | Hammond, Jr. | 91/465 X |
| 3,049,101 | 8/1962 | Ruhl | 91/447 X |
| 3,127,688 | 4/1964 | Hein et al. | 91/445 X |
| 3,274,902 | 9/1966 | Kleckner | 137/596.2 X |
| 3,523,490 | 8/1970 | Bianchetta | 91/420 |
| 3,788,401 | 1/1974 | Scheidt et al. | 91/445 X |
| 3,795,255 | 3/1974 | Malott et al. | 91/420 X |
| 3,800,670 | 4/1974 | Hufeld et al. | 91/420 |
| 3,908,515 | 9/1975 | Johnson | 91/445 X |
| 4,006,667 | 2/1977 | Bianchetta et al. | 91/445 |
| 4,018,350 | 4/1977 | Brown | 91/447 X |

*Primary Examiner*—Irwin C. Cohen
*Attorney, Agent, or Firm*—Phillips, Moore, Weissenberger, Lempio & Majestic

[57] ABSTRACT

A fluid source for delivering fluid to a control valve having Float, First direction and Second direction positions. A piston-bore check valve allows flow to the motor and normally blocks reverse flow, the piston having its first end biased against a seat. A control chamber communicates with the piston's second end. Flow is restricted between the motor's first end and the control chamber and there is a full flow path between the motor's first end and the bore to provide a force acting against the piston's first end. The control chamber connects with a sump. A drain valve entry port communicates with the motor's first end and an exit port thereof communicates with the sump to provide either entry port-exit port connection or blocking. A mechanism moves responsive to shifting of the control valve to shift the drain valve to connect the entry and exit ports when the control valve is in a Float or a Lower position and to block such connection in a Raise or Neutral position.

8 Claims, 1 Drawing Figure

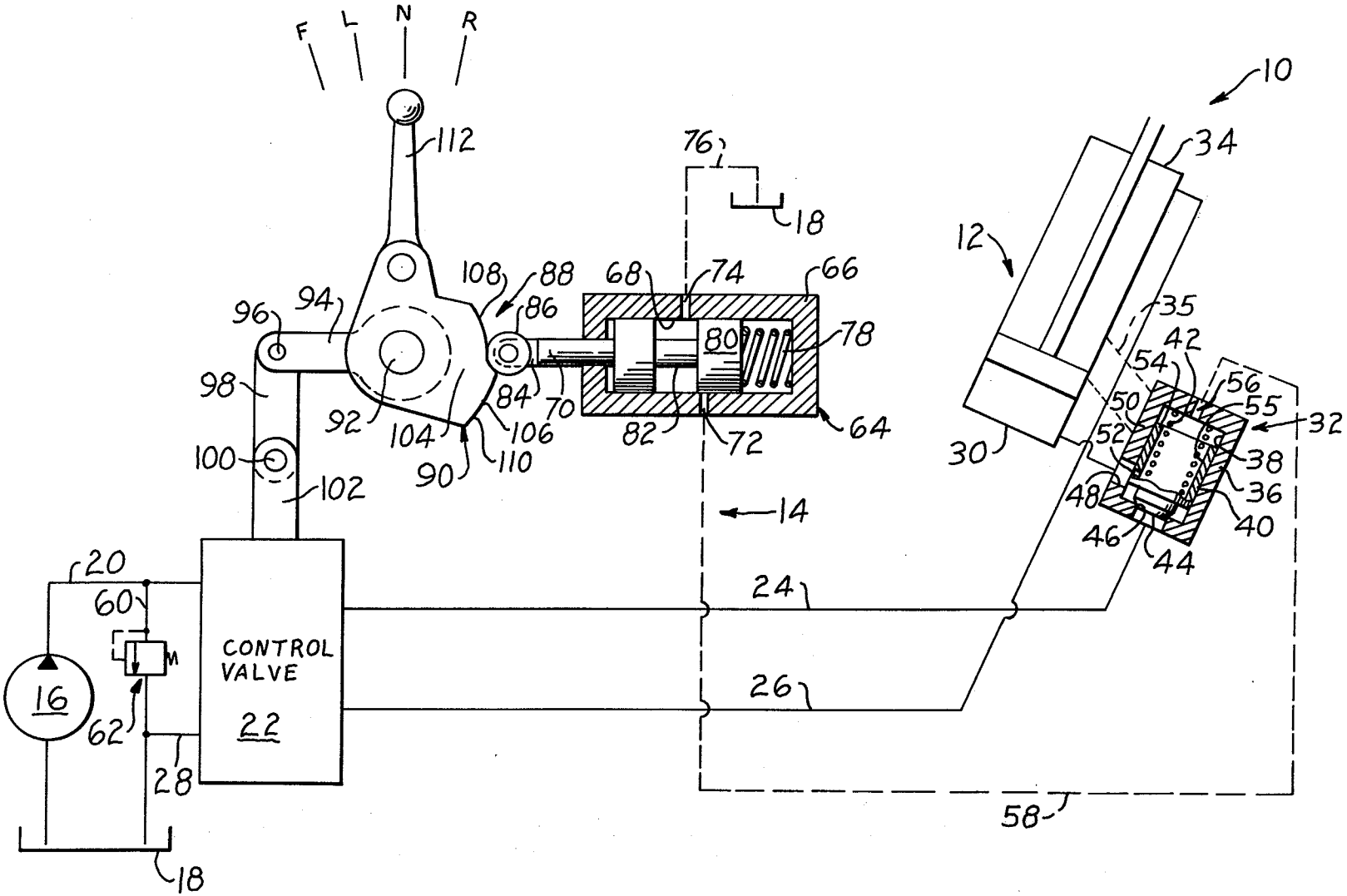
CONTROL VALVE
22
R
N
L
F
M

VENT CONTROL FOR CYLINDER MOUNTED LOAD CHECK VALVES

BACKGROUND OF THE INVENTION

1. Field of the Invention

The invention is concerned with a hydraulic motor and a control system therefor and more particularly with improvements in the control system which allow the hydraulic motor to operate in any of a Neutral (Hold), Float, Raise or Lower position. Such a control system is particularly advantageous when used with various types of earth working equipment such as, for example, a front loading loader, a lift piston of a tractor-scraper, a dozer and the like.

2. Prior Art

Control valves for hydraulic motors are known which provide Float, Neutral, Raise and Lower positions. Further, a particular safety problem exists with prior art hydraulic motors control systems, which problem is that the pressure from the pump to the hydraulic motor of such a system may be suddenly cut off during Raise or Neutral operation due to the breakage of the line therebetween, failure of the pump, or failure of the engine driving the pump. In such an instance and particularly in cases of line breakage, if the hydraulic motor was holding a load in a Raised position, the load can fall very quickly under the influence of gravity thus causing potentially great harm to the load itself and to the equipment.

The present invention provides a particular control system-hydraulic motor combination which eliminates this problem of a fast falling load, but at the same time retains each of the Float, Neutral (or Hold), Lower and Raise positions of opertaion for the control system and which further operates solely by mechanical means thus providing quick and positive action and shifting between the Float position, the Neutral position, the Raise position and the Lower position.

SUMMARY OF THE INVENTION

The present invention is directed to overcoming one or more of the problems as set forth above.

The invention provides an improvement in a hydraulic motor and control system therefor which comprises fluid source means for delivering fluid from sump means via first conduit means to control valve means having a Float position wherein a first end of said motor flow communicates with the sump means, a First position for applying fluid to power the motor in a first direction by delivering fluid to the motors first end via second conduit means and a Second position in which said control valve means applies fluid from said fluid supply source means to power said motor in a second direction by delivering said fluid to a second end thereof via third conduit means. The improvement comprises check valve means in the second conduit means allowing flow to the motors first end and normally blocking reverse flow therethrough, the check valve means being operable to allow said reverse fluid flow therethrough responsive to communication to said sump means via check valve means and drain conduit means of a pilot flow from said first end of said motor which is applied to said check valve means to oppose the biasing thereof; drain valve means having an entry port in communication with said check valve means to receive said pilot flow therefrom and an entry port in communication with said sump means, said drain valve means providing interconnection between said entry and exit ports in a first position thereof and blocking interconnection between said entry and exit ports in a second position thereof and including biasing means normally biasing said drain valve means towards a respective one of said first and second positions thereof; and mechanical means moving responsive to shifting of the control valve means to shift the drain valve means into the first position thereof when the control valve means is in the Second and Float positions and into the second position thereof when the control valve means is in the First position, said mechanical means comprising bellcrank means linked via first linking means at a first arm thereof to said control valve means, directly linked via second linking means at a second arm thereof to said drain valve means and pivoted to frame means intermediate said first and second arms thereof, said mechanical means exerting a force directly upon said drain valve means in opposition to said biasing means sufficient to position said drain valve means in said first position in said Second and Float control valve positions and in said second position and said First control valve position, said second linking means comprising a cam surface on said second arm of said bellcrank means, and, cam follower means on a first end of a drain spool of said drain valve means, said cam surface moving on rotation of said bellcrank means to position said drain spool in said first position responsive to shifting of said control valve means into said Lower and Float positions and position said drain spool into said second position responsive to shifting of said control valve means into said First position.

BRIEF DESCRIPTION OF THE DRAWING

The invention will be better understood by reference to the single FIGURE of the single drawing thereof which illustrates partially schematically and partially in section an improvement in accordance with the present invention.

DETAILED DESCRIPTION OF THE PREFERRED EMBODIMENT

While the following description is directed particularly to a system which includes a hydraulic motor arranged to raise and lower loads, it is to be understood that the present invention equally relates to horizontal motors and that, hence, the terms Raise and Lower as used herein are merely illustrative of the broader terms "power in a first direction" and "power in a second direction," respectively. Also, while the following description is of a double acting motor the system described is equally applicable to single acting motors as, for example, lift truck mast extension cylinders and the like.

Referring first to FIG. 1 there is illustrated therein a hydraulic motor-control system 10, which includes a hydraulic motor 12 along with a control system 14. The control system 14 includes a pump 16 which pumps fluid from a sump 18 via a first conduit 20 through a control valve 22. The control valve 22 is of a conventional type which will direct fluid flow from the first conduit 20 either to a second conduit 24 or to a third conduit 26. The control valve 22 has internal connections which provide a Float position in which the first conduit 20, the second conduit 24 and the third conduit 26 communicate with a fourth or sump conduit 28, which conduit 28 communicates with the sump 18. The control valve 22 further provides a Neutral position in which the second conduit 24 and the third conduit 26 are isolated by the control valve 22 from the sump 18, and a first conduit 20 communicates via the control valve 22 with the sump 18. The control valve 22 also provides a Raise position in which the third conduit 26 communicates via the control valve 22 with the fourth conduit 28 and the first conduit 20 communicates via the control valve 22 with the second conduit 24. In addition, the control valve 22 conventionally provides internal connections which provide a Lower position in which the second conduit 24 communicates via the control valve 22 with the fourth conduit 28 and the first conduit 20 communicates via the control valve 22 with the third conduit 26. It should be noted that the present invention is not concerned with any improvement in the control valve 22 per se but instead is concerned with an overall improvement in the control system 14 which operates the hydraulic motor 12, and which allows the conventional control valve 22 to operate in each of its positions while still solving the problem of fast dropping loads in cases of hydraulic line breakage.

The second conduit 24 communicates with a first end 30 (preferably the head end to provide maximum force on load raising) of the hydraulic motor 12. A check valve 32 is in the second conduit 24 and is raised to allow fluid flow therethrough due to the pressure of said fluid flow when the control valve 22 is in the Raise position (when fluid is being pumped towards the first end 30 of the hydraulic motor 12). The check valve 32 normally blocks fluid flow therethrough when the control valve 22 is in the Lower position (when fluid is flowing out of the first end 30 of the hydraulic motor 12) and in the Float position (when the first end 30 of the hydraulic motor 12, and, in a double acting motor a second end 34 thereof also communicate with the sump 18 but is operable as explained below by creating a pressure drop thereacross to allow flow out of the first end 30 of the motor 12 in said Lower and Float positions). The check valve 32 can be directly mounted to the motor 12 as indicated schematically by dashed lines 35 to minimize or even eliminate the length of the second conduit 24 between the check valve 32 and the motor 12 thus eliminating the possibility of breakage of this line. The check valve 32 comprises a check valve body 36 having a bore 38 therewithin in which a sleeve-piston 40 slidingly fits as biased by a spring 42 with a closed end 44 of the sleeve-piston 40 being biased by the spring 42 to sit against a seat 46 of the check valve body 38. When pressure from the pump 16 is being passed from the first conduit 20 via the control valve 22 to the second conduit 24, this pressure then applies against the closed end 44 of the sleeve-piston 40 forcing it to leave the seat 46 by overcoming the biasing of the spring 42 whereby fluid flow proceeds through a port 48 in a side 50 of the check valve body 36 and thence via a continuation of the second conduit 24 to the first end 30 of the hydraulic motor 12. When fluid is flowing out of the first end 30 of the hydraulic motor 12, it flows via the continuation of the second conduit 24 through the port 48 into a flow restriction hole 52 in a side 54 of the sleeve-piston 40, which hole 52 passes latitudinally through said side 54 to a central bore 55 of the sleeve-piston 40 which along with the bore 38 forms control chamber means for the check valve 32 and thence via an egress 56 from the check valve bore 38. From the egress 56 the hydraulic fluid leaving the first end 30 of the hydraulic motor 12 then passes via a fifth or drain conduit 58 from whence it can be directed to a sump 18 in the Lower and Float modes in a manner which will be explained in following. Meanwhile, the full pressure in the first end 30 of the hydraulic motor 12 is applied against a portion of the closed end 44 (first end) of the sleeve-piston 40 via the port 48. Due to the pressure differential thus created the closed end 44 of the sleeve-piston 40 lifts off of the seat 46 and flow can proceed back towards the control valve 22 and on to the sump 18. Flow to and from the second end 34 of the hydraulic motor 12 proceeds via the control valve 22 and the fourth conduit 28 under the normal mode of operation for the control valve 22.

A sixth or relief conduit 60 provides a path to drain from the first conduit 20 via a pressure relief valve 62 in the Raise and Lower positions so as to provide regulation of the maximum pressure developable in the first conduit 20 and hence in the first end 30 and the second end 34 of the hydraulic motor 12.

A drain valve 64 is provided in the drain conduit 58. The drain valve 64 includes a drain valve body 66, a drain bore 68 and a drain spool 70. An entry port 72 provides entry for any fluid being conducted by the drain conduit 58 to the drain bore 68. An exit port 74 provides an exit from the drain bore 68 to the seventh conduit 76 and thence to the sump 18. The spool 70 can be either in a first position wherein fluid flow interconnection occurs from the entry port 72 to the exit port 74 or in a second position, as actually illustrated in the FIGURE, wherein flow from the entry port 72 to the exit port 74 is blocked. Normally, the drain spool 70 is biased by a spring 78 into the second position. In this position, a land 80 on the spool 70 serves to block the entry port 72. When the drain spool 70 is shifted rightwardly to the first position thereof, the land 80 is moved rightwardly against the biasing force of the spring 78 and fluid can pass about an undercut 82 in the spool 70 and thence via the exit port 74 to the sump 18. Attached to a first or outer end 84 of the drain spool 70 is a roller 86 which is adapted to move upon cam means 88 of a bellcrank 90 in a manner which will become apparent in the following.

The bellcrank 90 is centrally pivoted to a pin 92 of a frame structure. A first arm 94 of the bellcrank 90 is pivotally connected at a pivot 96 to a link 98, which link 98 is pivotally mounted at a pivot 100 to a control spool 102 of the control valve 22. A second arm 104 of the bellcrank 90 has the aforementioned cam means 88 formed thereon. As the bellcrank 90 is rotated about the fixed pivot or pin 92 the roller 86 rolls upon the cam surface 106. When the control spool 102 is either in the Neutral or Raise position, the roller is on a first part 108 of the cam surface 106 and when the control spool 102 is in the Lower or Float position, the roller 86 is on a second part 110 of the cam surface 106. When the roller 86 sits upon the first part 108 of the cam surface 106, the spring 78 biases the drain spool 70 leftwardly into the second position wherein the entry 72 is blocked off by the land 80. When the roller 86 is upon the second part 110 of the cam surface 106, the drain spool 70 is forced rightwardly against the biasing of the spring 78 and the entry port 72 then communicates with the undercut 82 of the drain spool 70, which undercut 82 likewise communicates with the exit port 74 of the drain valve 64 thus providing a drain path to the sump 18 for the limited amount of pilot fluid which passes through the hole 52. It is clear that as a handle 112 is moved to set up a desired operating condition for the hydraulic motor 12, both the control valve 22 and the drain valve 64 are simultaneously shifted to desired positions whereby the overall control system 14 will allow the hydraulic motor 12 to operate in each of the Float, Lift, Neutral and Raise positions. Thus, a swift and positive acting control is provided and further, safety is provided whereby loads can be lowered relatively slowly if they are being lifted in a Raise position or being held aloft in a Neutral position and, for example, the second conduit 24 breaks or the pump 16 stops operating.

While the invention has been described in connection with specific embodiments thereof, it will be understood that it is capable of further modification, and this application is intended to cover any variations, uses or adaptations of the invention following, in general, the principles of the invention and including such departures from the present disclosure as come within known or customary practice in the art to which the invention pertains and as may be applied to the essential features hereinbefore set forth, and as fall within the scope of the invention and the limits of the appended claims.

The embodiments of the invention in which an exclusive property or privilege is claimed are defined as follows:

1. In a hydraulic motor and control system therefor which comprises fluid source means for delivering fluid from sump means via first conduit means to control valve means having a float position wherein a first end of said motor is in flow communication with sump means, a first position for applying fluid from said fluid source means to power said motor to move in a first direction by delivering said fluid to said first end thereof via second conduit means and a second position in which said control valve means applies fluid from said fluid supply source means to power said motor in a second direction by delivering said fluid to a second end thereof via third conduit means; and sump conduit means communicating said control valve means with sump means; an improvement comprising:

check valve means in said second conduit means allowing fluid flow therethrough to said first end of said motor and normally biased to block reverse fluid flow therethrough from said first end of said motor to said control valve means, said check valve means being operable to allow said reverse fluid flow therethrough responsive to communication to said sump means via check valve means and drain conduit means of a pilot flow from said first end of said motor which is applied to said check valve means to oppose the biasing thereof;

drain valve means having an entry port in communication with said check valve means to receive said pilot flow therefrom and an entry port in communication with said sump means, said drain valve means providing interconnection between said entry and exit ports in a first position thereof and blocking interconnection between said entry and exit ports in a second position thereof and including biasing means normally biasing said drain valve means towards a respective one of said first and said second position thereof;

mechanical means moving responsive to shifting of said control valve means to shift said drain valve means into said first position thereof when said control valve means is in said second and float positions and into said second position thereof when said control valve means is in the first position, said mechanical means comprising bellcrank means linked via first linking means at a first arm thereof to said control valve means, directly linked via second linking means at a second arm thereof to said drain valve means and pivoted to frame means intermediate said first and second arms thereof, said mechanical means exerting a force directly upon said drain valve means in opposition to said biasing means sufficient to position said drain valve means in said first position in said second and float control valve position and in said second position in said first control valve position, said second linking means comprising a cam surface on said second arm of said bellcrank means, and, cam follower means on a first end of a drain spool of said drain valve means, said cam surface moving on rotation of said bellcrank means to position said drain spool in said first position responsive to shifting of said control valve means into said lower and float positions and to position said drain spool into said second position responsive to shifting of said control valve means into said first position.

2. An improvement as in claim 1, wherein said motor is a double acting motor and in said second position said control valve means applies fluid from said fluid supply source means to power said motor in said second direction by delivering said fluid to a second end thereof via third conduit means.

3. An improvement as in claim 2, wherein said control valve means comprises:

a control valve body and a control spool movable linearly into and out of said control valve body, the positioning of said control spool providing as said float position a mode in which said first, second and third conduit means communicate thereby with said sump conduit means, as said first position a raise mode in which said third conduit means communicates thereby with said sump conduit means and said first conduit means communicates thereby with said second conduit means and as said Second position a lower mode in which said second conduit means communicates thereby with said sump conduit means and said first conduit means communicates thereby with said third conduit means.

4. In a hydraulic motor and control system therefor which comprises fluid source means for delivering fluid from sump means via first conduit means to control valve means having a float position wherein a first end of said motor is in flow communication with sump means, a first position for applying fluid from said fluid source means to power said motor to move in a first direction by delivering said fluid to said first end thereof via second conduit means and a second position for applying fluid from said fluid source means to power said motor to move in a second direction by delivering said fluid to a second end thereof via third conduit means; and sump conduit means communicating said control valve means with sump means; an improvement comprising:

check valve means in said conduit means allowing fluid flow therethrough to said first end of said motor and normally biased to block reverse fluid flow therethrough from said first end of said motor to said control valve means, said check valve means being operable to allow said reverse fluid flow therethrough responsive to communication to said sump means via check valve means and drain conduit means of a pilot flow from said first end of said motor which is applied to said check valve means to oppose biasing thereof;

drain valve means having an entry port in communication with said check valve means to receive said pilot flow therefrom and an exit port in communication with said sump means, said drain valve means providing interconnection between said entry and exit ports in a first position thereof and blocking interconnection between said entry and exit ports and a second position and including biasing means normally biasing said drain valve means towards said second position thereof;

mechanical means moving responsive to shifting of said control valve means to shift said drain valve means into said first position thereof when said control valve means is in said second and float positions and into said second position thereof when said control valve means is in the first position, said mechanical coupling means comprising bellcrank means linked via first linking means at a first arm thereof to said control valve means, directly linked via second linking means at a second arm thereof to said drain valve means and pivoted to frame means intermediate said first and second arms thereof, said mechanical means exerts a force directly upon said drain valve means in opposition to said biasing means sufficient to shift said drain valve means to said first position in said second and float control valve positions, said second linking means comprising:

a cam surface on said second arm of said bellcrank means; and roller means on a first end of a drain spool of said drain valve means, said cam surface moving on rotation of said bellcrank means to force said drain spool into said first position responsive to shifting of said control valve means into said second and float positions and to allow said drain spool to shift into said second position under the impetus of said drain valve means biasing means responsive to shifting of said control valve means into said first position.

5. An improvement as in claim 4, wherein said first linking means of said first arm of said bellcrank means to said control valve means comprises a link therebetween pivotally attached to each of said first arm of said bellcrank means and said control valve means.

6. An improvement as in claim 5, wherein said drain valve interconnection between said entry and exit ports comprises an undercut in said drain spool and said drain valve blocking between said entry and exit ports is accomplished by a land of said drain spool.

7. An improvement as in claim 6, wherein said check valve means includes piston means slidably fitting within bore means, biasing means biasing a first end of said piston means against seat means, control chamber means communicating with a second end of said piston means, flow restriction means communicating said first end of said motor with said control chamber means and substantially full flow means communicating said first end of said motor with said bore means to provide a force acting against said first end of said piston means to overcome said biasing means when said drain valve means is in said first position thereof.

8. An improvement as in claim 6, wherein said piston means comprises a sleeve-piston with said first end thereof closed and biased against said seat means in a check valve body, said seat means communicating with said second conduit means, said check valve means opening in said raise position to allow fluid flow therepast to said first end of said motor via a continuation of said second conduit means, said sleeve-piston including as said restriction means a hole latitudinally therethrough to a central bore thereof which comprises said control chanber means, said hole being open to said first end of said motor in said lower and float positions and said check valve body including an egress communicating said central bore of said sleeve-piston with said drain conduit means.

* * * * *

UNITED STATES PATENT AND TRADEMARK OFFICE

CERTIFICATE OF CORRECTION

PATENT NO. : 4,130,049

DATED : December 19, 1978

INVENTOR(S) : LLOYD D. FINLEY ET AL

It is certified that error appears in the above-identified patent and that said Letters Patent are hereby corrected as shown below:

Column 8, Claim 8, line 23, after "claim" and before "," the number "6" should read --7--.

Signed and Sealed this

*Twenty-second* Day of *January 1980*

[SEAL]

*Attest:*

SIDNEY A. DIAMOND

*Attesting Officer*

*Commissioner of Patents and Trademarks*